US005313761A

United States Patent [19]

Leopold

[11] Patent Number: 5,313,761

[45] Date of Patent: May 24, 1994

[54] INSULATING GLASS UNIT

[75] Inventor: Edmund A. Leopold, Hudson, Ohio

[73] Assignee: Glass Equipment Development, Inc., Twinsburg, Ohio

[21] Appl. No.: 827,281

[22] Filed: Jan. 29, 1992

[51] Int. Cl.[5] ..... E04C 2/54

[52] U.S. Cl. ..... 52/788; 52/790; 52/658; 52/656.1; 52/656.9; 52/456

[58] Field of Search ..... 52/788, 790, 658, 172, 52/656.1, 656.9, 658, 456, 656

[56] References Cited

U.S. PATENT DOCUMENTS

| | | | |
|---|---|---|---|
| 1,877,336 | 9/1932 | Lovell et al. . | |
| 1,975,895 | 10/1934 | Geyer | 52/788 |
| 2,173,664 | 9/1939 | Shutts . | |
| 2,235,680 | 3/1941 | Haven et al. . | |
| 2,348,307 | 5/1944 | Richardson . | |
| 2,587,063 | 2/1952 | Petsch . | |
| 2,625,717 | 1/1953 | Wampler et al. . | |
| 2,750,637 | 6/1956 | Browne . | |
| 2,768,475 | 10/1956 | Seelen et al. . | |
| 2,869,694 | 1/1959 | Breckheimer | 52/658 |

(List continued on next page.)

FOREIGN PATENT DOCUMENTS

| | | |
|---|---|---|
| 0132516 | 4/1984 | European Pat. Off. . |
| 0305352 | 8/1987 | European Pat. Off. . |
| 0475213 | 8/1991 | European Pat. Off. . |
| 2506298 | 2/1975 | Fed. Rep. of Germany . |
| 2637034 | 2/1978 | Fed. Rep. of Germany . |
| 8805653 | 8/1988 | Fed. Rep. of Germany . |
| 2428728 | 6/1979 | France . |
| 2449222 | 2/1980 | France . |
| 349875 | 6/1931 | United Kingdom . |
| 1509178 | 5/1975 | United Kingdom . |
| 2072249 | 9/1981 | United Kingdom . |

OTHER PUBLICATIONS

Copy of European Search Report dated Jun. 4, 1993 on European Application No EP 93 100393.3.

Technical report dated May 1988 by M. Glover and G. Reichert of Edgetech I. G. Ltd. entitled "Super Spacer TM."

Advertisement dated Mar. 15, 1990, in *Glass Digest* for "Versa-Therm" framing system by Tubelite Indal.

Article dated 1989 in ASHERA (American Society of Heating, Refrigerating and Air Conditioning Engineers) Transactions (vol. 95, Pt.2) by J. L. Wright, P. E. and H. F. Sullivan Ph.D., P. E. entitled "Thermal Resistance Measurement of Glazing System Edge-Seals and Seal Materials Using a Guarded Heater Plate Apparatus."

A page from a High Quality Tools catalog illustrating a Quill-Feed Speed Handle, HQT Part No. 1021.

*Primary Examiner*—Carl D. Friedman
*Assistant Examiner*—Christopher T. Kent
*Attorney, Agent, or Firm*—Watts, Hoffmann, Fisher & Heinke

[57] ABSTRACT

Spacer frame assembly for an insulating glass unit comprising a plurality of spacer frame elements connected to form a generally planar polygonal frame. Each frame element defines an impervious outer peripheral wall and first and second lateral walls, integral with the outer wall, extending inwardly from opposite outer wall sides parallel to the frame plane. The outer wall and lateral walls extend substantially continuously about the frame polygon and are joined adjacent their ends by connecting structure. The connecting structure comprises a connecting tongue continuous with and projecting from an end of one frame element. The other frame element end has a tongue receiving structure and the element ends are telescopically joined. Muntin bars are secured to the frame elements by latching structures which assure quick muntin bar assembly.

21 Claims, 4 Drawing Sheets

U.S. PATENT DOCUMENTS 3,021,243 2/1962 Bethge .
3,026,582 3/1962 Bayer .
3,030,673 4/1962 London .
3,045,297 7/1962 Ljungdahl .
3,054,153 9/1962 Partsch .
3,105,274 10/1963 Armstrong .
3,212,179 10/1965 Koblensky .
3,267,569 8/1966 Eichhorn et al. .
3,280,523 10/1966 Stroud et al. .
3,283,890 11/1966 Morris et al. .
3,657,900 4/1972 Bowser et al. .
3,919,023 11/1975 Bowser et al. .
3,974,823 8/1976 Patil .
4,015,394 4/1977 Kessler .
4,057,945 11/1977 Kessler .
4,063,002 12/1977 Wilson, Jr. .
4,084,720 4/1978 Thurston ..... 52/658
4,109,431 8/1978 Mazzoni et al. .
4,222,213 9/1980 Kessler .
4,431,691 2/1984 Greenlee .
4,513,546 4/1985 Gow .
4,520,611 6/1985 Shingu et al. .
4,530,195 7/1985 Leopold .
4,546,723 10/1985 Leopold et al. .
4,597,232 7/1986 Lingemann ..... 52/172
4,622,249 11/1986 Bowser .
4,628,582 12/1986 Leopold .
4,780,164 10/1988 Rueckheim et al. .
4,807,419 2/1989 Hodek et al. .
4,808,452 2/1989 McShane .
4,831,799 5/1989 Glover et al. .
4,856,243 8/1989 Ault et al. .
4,873,803 10/1989 Rundo .
4,970,840 1/1990 Ouellette et al. .
4,989,384 2/1991 Kinghorn et al. .
5,099,626 3/1992 Seeger ..... 52/790
5,177,916 1/1993 Misera et al. ..... 52/172

INSULATING GLASS UNIT

FIELD OF THE INVENTION

The present invention relates to an insulating glass unit and particularly to an improved insulating glass unit spacer assembly.

BACKGROUND OF THE INVENTION

Insulating glass units (IGUs) are used in windows to reduce heat loss from building interiors during cold weather. IGUs are typically formed by a spacer assembly sandwiched between glass lights. A spacer assembly usually comprises a frame structure extending peripherally about the unit, a sealant material adhered both to the glass lights and the frame structure, and a desiccant for absorbing atmospheric moisture within the unit. The margins of the glass lights are flush with or extend slightly outwardly from the spacer assembly. The sealant extends continuously about the frame structure periphery and its opposite sides so that the space within the IGU is hermetic.

There have been numerous proposals for constructing IGUs. One type of IGU was constructed from an elongated body of hot melt material having a corrugated sheet metal strip embedded in it. Desiccant was also embedded in the hot melt. The resulting composite frame forming strip was bent into a rectangular shape and sandwiched between conforming glass lights.

Perhaps the most successful IGU construction has employed tubular, roll formed aluminum or steel frame elements connected at their ends to form a square or rectangular spacer frame. Particulate desiccant deposited inside the tubular frame elements communicated with air trapped in the IGU interior to remove the entrapped airborne water vapor and thus preclude its condensation within the unit. The frame sides and corners were covered with sealant formed by a hot melt material for securing the frame to the glass lights. The sealant provided a barrier between atmospheric air and the IGU interior which blocked entry of atmospheric water vapor. Thus after the water vapor entrapped in the IGU was removed internal condensation only occurred when the unit failed.

Among other reasons, units failed because atmospheric water vapor infiltrated the sealant barrier. Infiltration tended to occur at the frame corners because the opposite frame sides were at least partly discontinuous there. For example, in some frames the corners were formed by cutting "V" shaped notches at corner locations in a single long tube. The notches enabled bending the tube to form mitred corner joints. After bending to form the corners potential infiltration paths extended along the corner parting lines substantially across the opposite frame faces at each corner.

In other frame constructions "corner keys" were inserted between adjacent frame element ends to form the corners. These corner keys produced potential infiltration paths at their junctures with the frame elements. In some constructions the corner keys were foldable so that the sealant could be extruded onto the frame sides as the frame moved linearly past a sealant extrusion station. The frame was then folded to a rectangular configuration with the sealant in place on the opposite sides. In some of these proposals the sealant was extruded into the space between the frame element end edges. When the frame was folded into its final form the sealant extruded between the element ends was not present at the frame corners. This reduction in the amount of sealant at the corners tended to cause vapor leakage paths into the IGU, particularly after the unit was in service over a period of time.

In all these proposals the frame elements were cut to length and, in the case of frames connected together by corner keys, the keys were installed before applying the sealant. These were manual operations. Accordingly, fabricating IGUs from these frames entailed generating scrap and inefficient manual operations.

Still other proposals for spacer frame constructions involved roll forming the spacer elements, sawing a V-shaped notch at each corner location so that the spacer members remained attached and foldable at the corner, filling frame members with desiccant and plugging them and then cutting off the frame member. The frame member was then coated with hot melt and folded onto its final configuration. The sawing, filling and plugging operations had to be performed by hand which slowed production of these frames.

It is known that heat losses from IGUs occur via conductive heat transfer at the edges of the units where the glass lights are attached. The extent of such losses depends upon the conductivity and geometry of the heat path between the lights. Roll formed spacer frames were tubular so that two frame element walls extended between the glass lights. The heat path extended from the warmer light through the sealant coating the adjacent frame side, both frame element walls extending between the lights, and through the sealant on the opposite frame side to the cooler light.

The sealant materials presented a heat flow path having a large cross sectional area and the hot melt materials themselves were not highly effective insulators. Accordingly the heat path through the sealants was capable of substantial heat conduction. The limiting factor in the heat path was the spacer frame walls. They had relatively small cross sectional areas which tended to restrict heat flow. However, frame element conductivity was great particularly because aluminum, the typical frame material, is highly conductive. Thus the heat losses due to conduction along the edges of the IGUs were significant.

Moreover, because the heat losses occurred along concentric paths spaced inwardly from the glass light peripheries, the warmer glass lights tended to be "cold" well inwardly from their peripheries. Beside the disadvantage of heat loss, cold edge IGUs caused other unacceptable problems. For example, condensation tended to occur on the margins of the warmer glass light. This was unsightly and the accumulated moisture was particularly destructive to wooden IGU support structures, such as wooden window frames. Furthermore, condensed moisture could freeze along the margins of the indoor light during cold weather. This threatened damage to the IGU support structure.

The present invention provides a new and improved IGU and method of making it wherein completed IGUs exhibit significantly reduced "cold edge" effects and spacer frame assembly construction is conducted at high production rates, creating little scrap and involving minimal handling. The new IGU is structurally strong and durable, functionally superior to the prior units and can be produced in a highly efficient manner.

DISCLOSURE OF THE INVENTION

The present invention provides a new and improved spacer frame assembly for an insulating glass unit comprising a plurality of spacer frame elements connected to form a generally planar polygonal frame. Each frame element defines an impervious outer peripheral wall and first and second lateral walls, integral with the outer wall, extending inwardly from opposite outer wall sides parallel to the frame plane. The outer wall and lateral walls extend substantially continuously about the frame polygon and are joined adjacent their ends by connecting structure. The connecting structure comprises a connecting tongue continuous with and projecting from an end of one frame element. The other frame element end has a tongue receiving structure and the element ends are telescopically joined.

Additional features of the invention will become apparent from the following detailed description of a preferred embodiment made with reference to the accompanying drawings.

DESCRIPTION OF A PREFERRED EMBODIMENT

Figure 1:
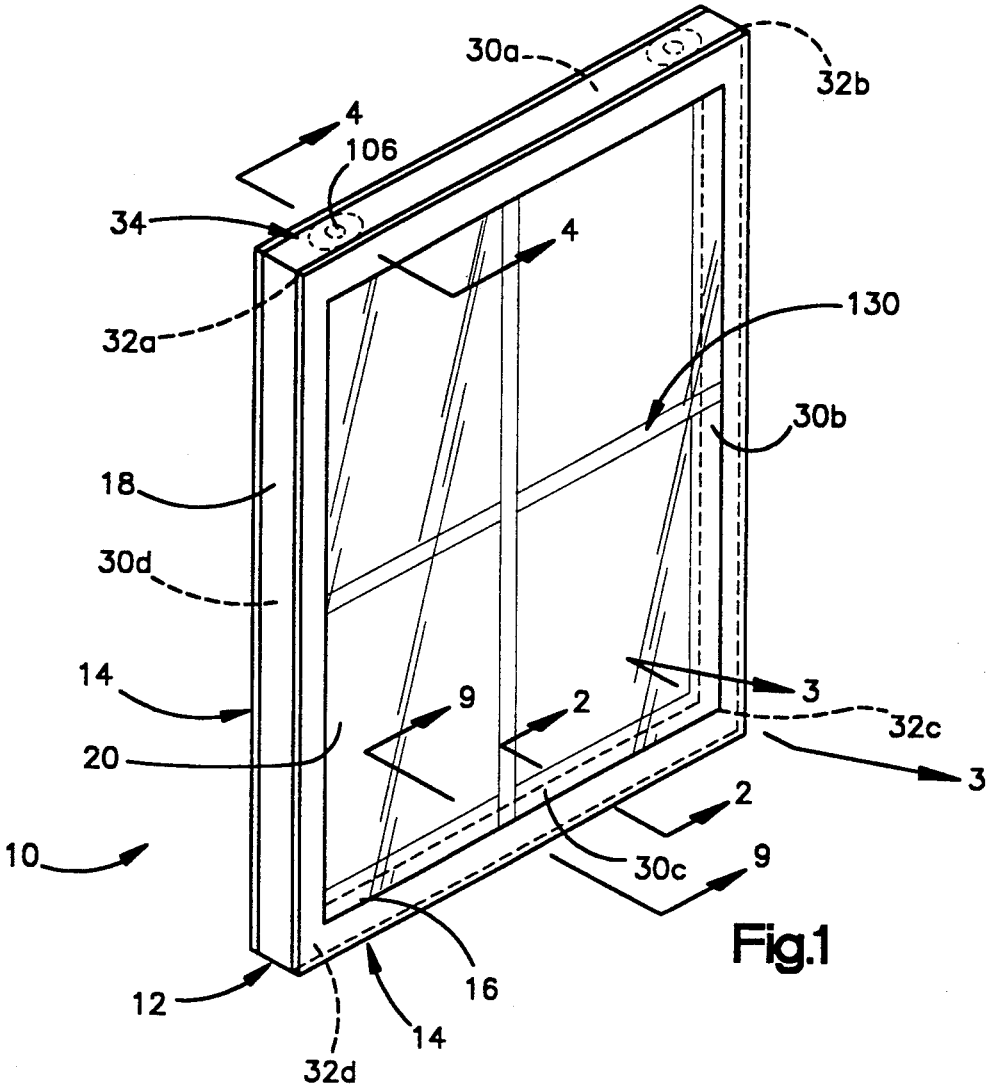
FIG. 1 is a perspective view of an insulating glass unit constructed according to the invention.
Figure 2:
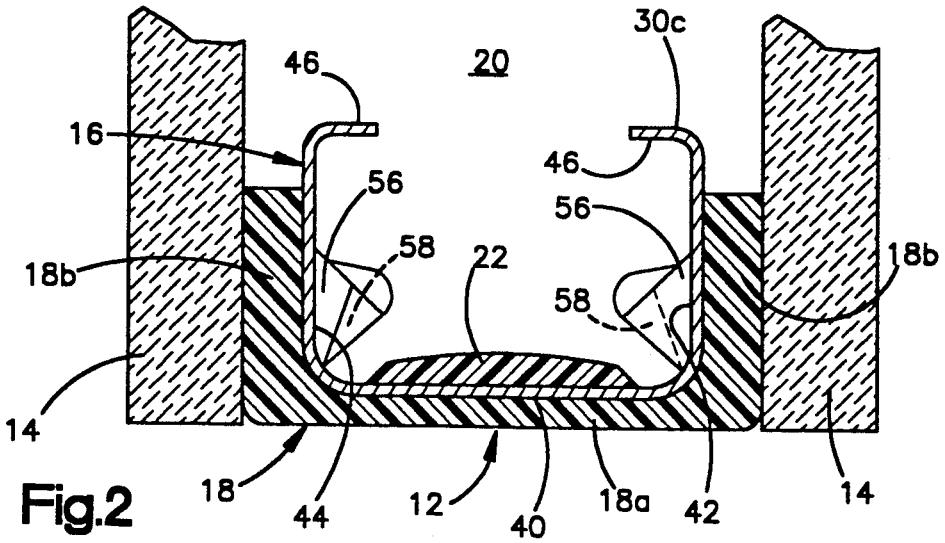
FIG. 2 is an enlarged fragmentary cross sectional view seen approximately from the plane indicated by the line 2—2 of FIG. 1.
Figure 3:
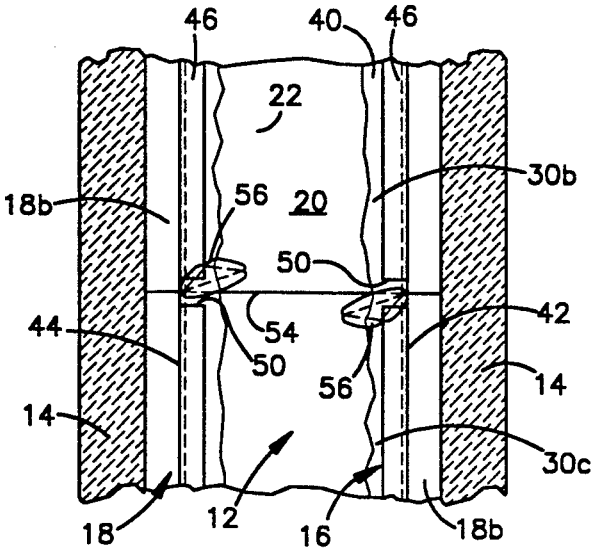
FIG. 3 is an enlarged fragmentary cross sectional view seen approximately from the plane indicated by the line 3—3 of FIG. 1.
Figure 4:
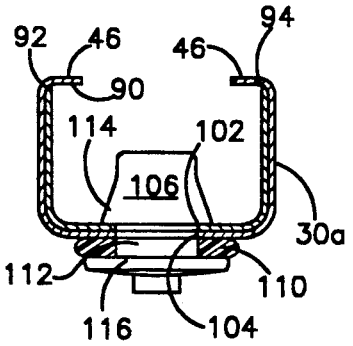
FIG. 4 is an enlarged fragmentary cross sectional view seen approximately from the plane indicated by the line 4—4 of FIG. 1.

An insulating glass unit 10 constructed according to the present invention is illustrated by FIGS. 1-3 as comprising a spacer assembly 12 sandwiched between glass sheets, or lights, 14. The assembly 12 comprises a frame structure 16, sealant material 18 for hermetically joining the frame to the lights to form a closed space 20 within the unit 10 and a body 22 of desiccant in the space 20. The unit 10 is illustrated as in condition for final assembly into a window or door frame, not illustrated, for ultimate installation in a building.

The glass lights 14 are constructed from any suitable or conventional glass. The lights are rectangular, aligned with each other and sized so that their peripheries are disposed just outwardly of the frame outer periphery. While it is not essential that the lights be transparent, the disclosure and description which follows assumes the unit 10 is used in a window frame installed in a building.

The assembly 12 functions to maintain the lights 14 spaced apart from each other to produce the hermetic insulating "dead air space" 20 between them. The frame 16 and the sealant body 18 coact to provide a structure which maintains the lights 14 properly assembled with the space 20 sealed from atmospheric moisture over long time periods during which the unit 10 is subjected to frequent significant thermal stresses. The desiccant body 22 serves to remove water vapor from air, or other gas, entrapped in the space 20 during construction of the unit 10.

The sealant body 18 both structurally adheres the lights 14 to the spacer assembly 12 and hermetically closes the space 20 against infiltration of airborne water vapor from the atmosphere surrounding the unit 10. The illustrated body 18 is formed from a "hot melt" material which is attached to the frame sides and outer periphery to form a U-shaped cross section. In constructing the preferred unit 10 the sealant body 18 is extruded onto the frame 16. This is accomplished for example by passing the frame through a sealant application station of an extruder such as that disclosed by U.S. Pat. No. 4,628,582. Although a "hot melt" sealant is disclosed, other suitable or conventional substances (singly or in combination) for sealing and structurally securing the unit components together may be employed.

After the sealant body 18 is attached to the frame 16 it is heated and the lights 14 and spacer assembly 12 are passed through the nips of a series of press rolls (not illustrated). The rolls compress the body 18 between the frame 16 and the lights 14 to adhere them firmly together. The hot melt forming the body 18 is a composition which assures strong adhesion to the frame and the lights by joints which are both structurally strong and impervious to atmospheric moisture infiltration of the space 20. The "bight" 18*a* of the U-shaped sealant body (FIG. 2) is continuous with the legs 18*b* and functions to lengthen the vapor barrier between the glass and the body while encapsulating the frame exterior.

Figure 5:
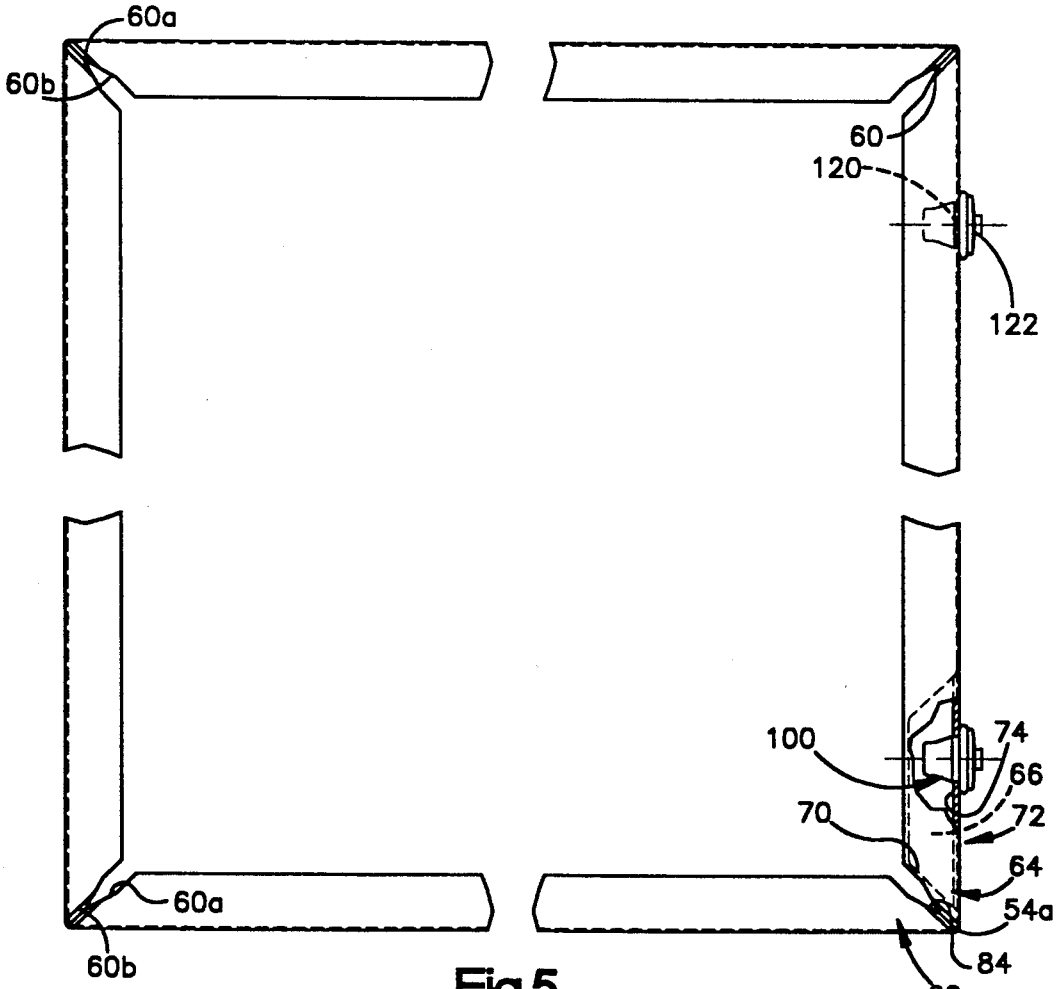
FIG. 5 is a fragmentary plan view of a spacer frame forming part of the unit of FIG. 1 which is illustrated in a partially constructed condition.
Figure 7:
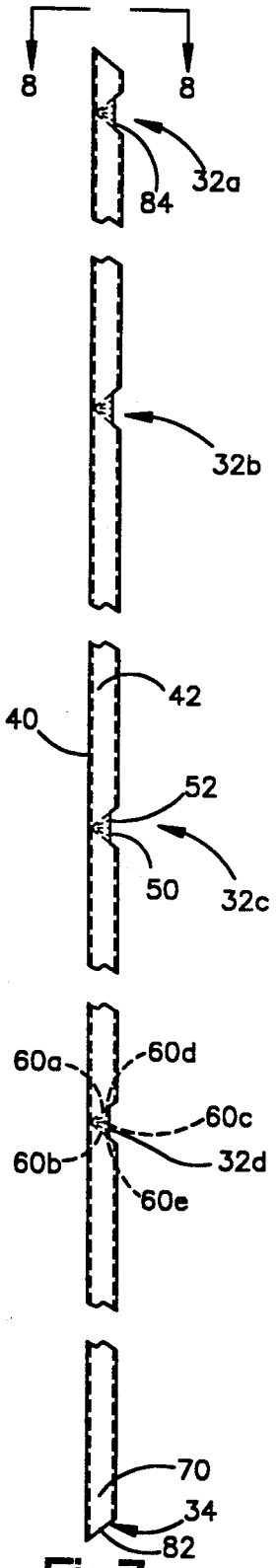
FIG. 7 is a fragmentary elevational view of the element of FIG. 6.
Figure 6:
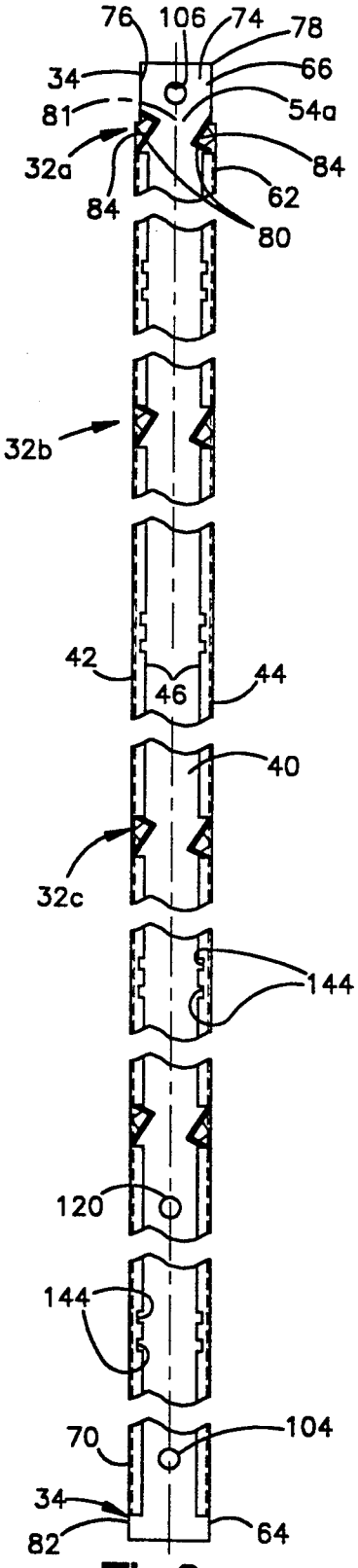
FIG. 6 is a fragmentary plan view of a spacer frame element before the element has had sealant applied and in an unfolded condition.
Figure 8:
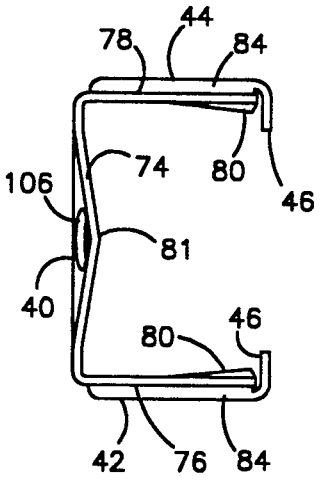
FIG. 8 is an enlarged elevational view seen approximately from the plane indicated by the line 8—8 of FIG. 7.
Figure 9:
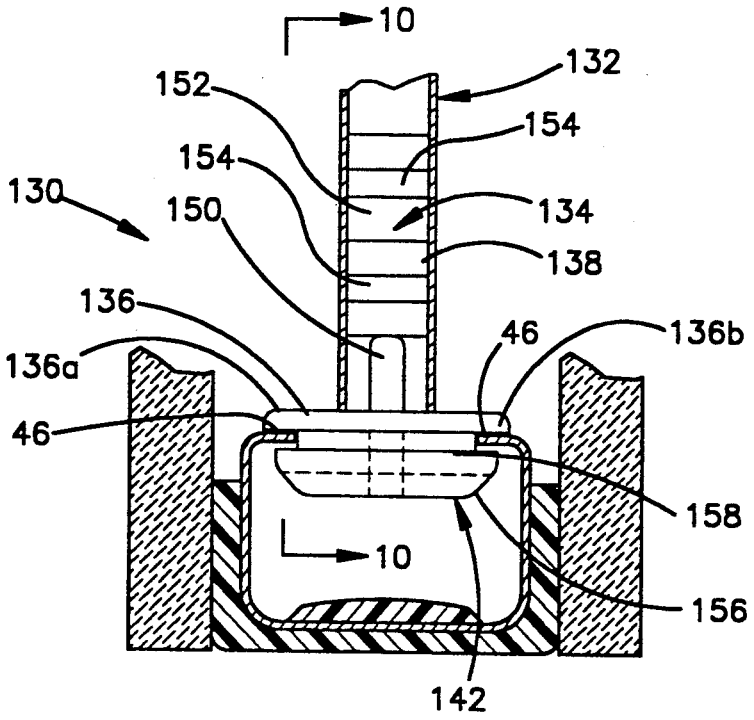
FIG. 9 is an enlarged fragmentary cross sectional view seen approximately from the plane indicated by the line 9—9 of FIG. 1; and, FIG. 10 is a view seen approximately from the plane indicated by the line 10—10 of FIG. 9.
Figure 10:
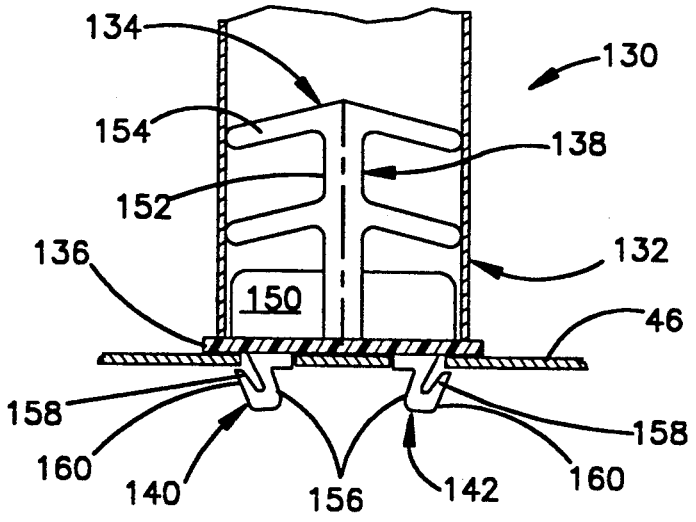

The frame 16 extends about the unit periphery to provide a structurally strong, stable spacer for maintaining the lights aligned and spaced while minimizing heat conduction between the lights via the frame. The preferred frame 16 comprises a plurality of spacer frame elements, or members, 30*a–d* (see FIGS. 5–7) connected to form a planar, polygonal frame shape with the frame element junctures forming frame corner structures 32*a–d*, and connecting structure 34 for joining opposite frame element ends to complete the closed frame shape.

Each frame member 30 is elongated and has a channel shaped cross section defining a peripheral wall 40 and first and second lateral walls 42, 44. See FIG. 2. The peripheral wall 40 extends continuously about the unit 10 except where the connecting structure 34 joins the frame member ends. The lateral walls 42, 44 are integral with respective opposite peripheral wall sides. The lateral walls extend inwardly from the peripheral wall 40 in a direction parallel to the planes of the lights and the frame. The preferred frame 16 has stiffening flanges 46 formed along the inwardly projecting lateral wall edges. The lateral walls 42, 44 rigidify the frame member 30 so it resists flexure and bending in a direction transverse to its longitudinal extent. The flanges 46 stiffen the walls 42, 44 so they resist bending and flexure transverse to their longitudinal extents.

The frame 16 is preferably constructed from a thin ribbon of stainless steel material (e.g. 304 stainless steel having a thickness of 0.006–0.010 inches) which is passed through forming rolls to produce the walls 40, 42, 44. The formed ribbon (see FIGS. 6 and 7) is an elongated linear rigid channel member. In the preferred and illustrated embodiment of the invention the desiccant body 22 is attached to the frame wall 40 and disposed on each of the frame members 30*a–d*. The desiccant body 22 is formed by a desiccated matrix in which a particulate desiccant is incorporated in a vehicle material which is adhered to the frame. The vehicle material may be silicone, hot melt, polyurethane, or other suitable materials. The desiccant absorbs moisture from the surrounding atmosphere for a time after the desiccant is exposed to the atmosphere. Thus the desiccant absorbs moisture from the atmosphere within the space 20 for some time after the unit 10 has been fabricated. This assures that condensation within the unit does not occur. In the preferred unit the desiccant body 22 is extruded onto the frame 16 by an extruder.

The frame corner structures 32 facilitate manual frame bending to the final, polygonal frame configuration in the unit 10 while assuring an effective vapor seal at the frame corners. In the preferred embodiment the frame 16 is initially formed in a single straight length with the sealant body 18 in place on the straight frame. The corner structures 32 initially comprise notches 50 and weakened zones 52 formed in the walls 42, 44 at frame corner locations. See FIGS. 6 and 7. The notches 50 extend into the walls 42, 44 from the respective lateral wall edges. The lateral walls 42, 44 extend continuously along the frame 16 from one end to the other. The walls 42, 44 are weakened at the corner locations because the notches reduce the amount of lateral wall material and eliminate the stiffening flanges 46.

The weak zones 52 at each corner act to restrict frame bending to a crease line 54 extending across the wall 40 at that corner and to form a pleat 56, or sealant pocket, at the corner. In the preferred embodiment the weak zones 52 are formed by a series of five score lines radiating across the lateral walls 42, 44 from the corner crease line location. The weak zones are bowed inwardly from the plane of their associated lateral walls. The sealant body 18 adheres and conforms to the inwardly bowed weak zones. When the frame is bent to its final configuration the weak zones 52 collapse inwardly (with the sealant adhered) in a controlled bending action which forms the pleat 56. Each pleat 56 forms a pocket-like conical, or pyramid shaped, channel 58 filled with sealant having its apex adjacent the corner crease line 54 and its base opening within the frame channel (see FIGS. 2 and 3).

The weak zones 52 are specially formed so that the frame corners are well defined, without use of tools or fixtures, simply by manually bending the frame into its final configuration. The controlled corner formation is assured in the preferred frame by score lines 60*a*, 60*b* extending normal to each other and at 45° angles from the plane of the wall 40. When the frame is bent the lines 60*a*, 60*b* define mitre-like creases in the lateral walls which confront each other when the frame corner forms a 90° angle.

The weak zones 52 are unsymmetrically formed about the centerline of the frame wall 40. Thus when the frame corners are bent the weak zones collapse inwardly to form the pleats without clashing. This is particularly important in constructing relatively narrow spacer assemblies (e.g. where the wall 40 is only about ⅜ inch wide). The score lines 60*c–e* are formed to assure this non clashing relationship. The line 60*c* bisects the angle between the lines 60*a*, 60*b* to define the inwardly projecting limit of pleat extension. The lines 60*d*, 60*e* respectively bisect the angle between the lines 60*a*, 60*c* and 60*b*, 60*c*. The score lines 60*d* in the frame wall 42 all weaken the wall more than the score lines 60*e* in the wall 42. The score lines 60*e* in the wall 44 all weaken the wall 44 more than do the score lines 60*d*. The weak zones are deformed, or dished, inwardly before the sealant is applied with the inward deformation being nonsymmetrical due to differential weakening. This differential weakening of the weak zones 52 is illustrated in an exaggerated way in FIG. 6. When the frame is bent to its final configuration the weakened zones collapse inwardly along nonintersecting skew lines so clashing is avoided.

The sealant is applied to the lateral walls 42, 44 at the corner locations before the frame is bent so the sealant adheres to the inwardly dished weak zone walls. Some of this sealant at the frame corners is entrapped within the pleats 56 after the frame is bent. This sealant fills the pleats to assure the conical channel 58 blocks vapor infiltration at the frame corner. Some sealant may well out of the pleats between the adjacent score lines 60 to the external lateral sides of each frame corner as the frame is bent. This is beneficial because adequate corner sealant is assured.

The connecting structure 34 secures the opposite frame ends 62, 64 together when the frame has been bent to its final configuration. The illustrated connecting structure comprises a connecting tongue structure 66 continuous with and projecting from the frame structure end 62 and a tongue receiving structure 70 at the other frame end 64. The preferred tongue and tongue receiving structures 66, 70 are constructed and sized relative to each other to form a telescopic joint 72. When assembled, the telescopic joint 72 maintains the frame in its final polygonal configuration prior to assembly of the unit 10.

In the preferred embodiment the tongue 66 is formed as a frame corner extension and comprises a tongue body 74 and tongue stiffening walls 76, 78. The tongue body 74 is formed an extension of the frame wall 40 and joins the wall 40 at a corner bend line 54*a*. A corner structure 32*a* is formed at the junctures of the tongue walls 76, 78 and the respective lateral walls 42, 44. When the sealant body 18 is applied to the frame structure it terminates at the corner structure 32*a* so that the tongue body and walls are free from any sealant material. The same is true of the desiccant body 22, which does not extend to the tongue 66.

After the sealant body has been applied to the frame 16 the frame is bent at the corners 32 into its final planar rectangular shape. The tongue 66 is bent about the corner bend line 54*a* for telescoping engagement with the tongue receiving frame end 64. The corner structure 32*a* defines tongue pleats 80 (similar to the pleats 56) respectively joining the frame walls 42, 44 with the respective tongue walls 76, 78. The preferred tongue body 74 is narrower than the wall 40 so that it can be inserted within the tongue receiving frame member end 64 to complete the telescopic joint 72. The tongue 66 is abruptly narrowed at the location where the tongue pleats 80 join the respective sidewalls 42, 44. The junctures of the tongue pleats and frame sidewalls each form a mitre-like angled step, or shoulder, 84.

The tongue body 74 is just enough narrower than the frame wall 40 that the tongue walls 76, 78 frictionally engage the respective receiving frame member walls 42, 44. Maintenance of the frictional fit between the tongue walls 76, 78 and the lateral frame walls 42, 44 is assured by a resiliently deflectable crown 81 extending along the longitudinal centerline of the tongue body 74. The crown is deflected somewhat as the tongue is inserted into the frame end 64 to provide a resilient spring-like effect urging the walls 76, 78 into engagement with the frame walls 42, 44.

In the preferred embodiment the tongue body 74 and tongue walls 76, 78 are subjected to a swedging operation after the frame members are substantially fully formed. The swedging operation narrows the tongue body by forcing some of the tongue body material into the tongue walls, thus reducing the tongue width. The swedging operation may also produce the crown 81.

The frame end 64 is formed so the walls 42, 44 terminate in a mitre cut edge 82 which, when the telescopic joint 72 is properly formed, confronts and extends immediately adjacent the shoulder 84. The shoulder 84 forms a stop for the edge 82 when the joint is fully assembled. The edge 82 is aligned with the shoulder 84 so that the exterior laterally facing frame surfaces at the corner structure 32*a* are in common planes.

The frame end 64 is constructed to provide a keeper structure for engaging the tongue wall edges 92, 94 when the telescopic joint is completed. The preferred keeper structure is formed by the lateral wall flanges 46 which serve to maintain the tongue 66 within the frame end 64, but other keeper structures, such as corrugations formed in the lateral frame walls 42, 44, could be employed if desired.

In the illustrated embodiment the connector structure 34 further comprises a fastener arrangement 100 for both connecting the opposite frame ends together and providing a temporary vent for the space 20 while the unit 10 is being fabricated. The illustrated fastener arrangement (see FIGS. 1, 4, 5 and 6) is formed by conforming holes 102, 104 located, respectively, in the tongue 66 and the frame end 64 and a rivet 106 extending through the holes 102, 104 for clinching the tongue 66 and frame end 64 together.

The holes 102, 104 readily communicate the air space 20 in the unit 10 to the ambient atmosphere when the unit 10 is first assembled before the rivet 106 is installed. The holes are aligned when the tongue and tongue receiving structure are telescoped together. The sealant body 18 at the location of the frame hole 104 defines an opening surrounding the hole. Likewise the desiccant body 22 does not obstruct the hole 104 because the desiccant body 22 is not applied to the frame end 64 in the vicinity of the hole 104. As noted above, the tongue hole 102 is also clear of sealant and the desiccant body because they are not applied to the tongue 66.

Accordingly when the unit 10 is heated and pressed to bond the lights 14 and spacer assembly 12 together, the holes 102, 104 communicate the space 20 to the surroundings and the space 20 remains at atmospheric pressure. This is to be distinguished from units which, after they are assembled and cooled down, exhibit inward light diaphragming which must be relieved by piercing the unit sealant.

The rivet 106 is installed after the unit 10 has been heated, pressed and cooled to about room temperature. In a preferred embodiment of the invention the space 20 is flooded with an inert gas (such as Argon) just before the rivet is placed. The rivet 106 is a "blind" rivet carrying a resilient sealing ring 110 about its central hollow shaft 112. When the rivet is set, its interior end 114 is upset and mushroomed into firm engagement with the tongue body 74. The rivet head 116 forces the sealing ring 110 into tightly compressed sealing engagement with the frame wall 40 surrounding the hole 104. No further communication through the holes is possible so the inert gas is trapped in the space 20.

After the rivet 106 is set, additional sealant is gunned or trowelled (or otherwise applied) onto the unit 10 to cover the rivet and the corner structure 32*a* where the opposite ends of the sealant body 18 meet. The material at the juncture of the sealant body ends is smoothed over to assure an effective vapor barrier at the corner 32*a*.

In some circumstances it may be desirable to provide two vents in the unit 10 so the inert gas flooding the space 20 can flow into the space 20 through one vent displacing residual air from the space through the second vent. The drawings shows such a unit. See FIGS. 1, 5 and 6. The second vent 120 is formed by a punched hole in the frame wall 40 spaced along the common frame member from the hole 104. The sealant body 18 and the desiccant body 22 each define an opening surrounding the vent 120 so that air venting from the space 20 is not impeded. The second vent 120 is closed by a blind rivet 122 identical to the rivet 106. The rivets 106, 122 are installed at the same time and each is covered with sealant material so that the seal provided by each rivet is augmented by the sealant material.

The unit 10 is illustrated as constructed to simulate the appearance of a multipane window. This is accomplished by the inclusion of a muntin bar simulating assembly 130 in the unit (FIG. 1). The muntin bar simulating assembly 130 is referred to here as a muntin bar assembly for simplicity, but it is not a true muntin bar assembly because the individual muntin bars do not connect with panes or lights in the windows.

The muntin bar assembly 130 comprises bar members 132 extending across the space 20 between the lights 14, and clips 134 for connecting the bars 132 to the spacer assembly 12. The bars 132 are formed by elongated metal tubes having generally rectangular cross sectional shapes. Each illustrated bar 132 extends between the mid-points of its associated frame members through the center of the space 20. The bars 132 are provided with dados at their intersection.

The clips 134 detachably secure the bars to the spacer frame 16. Each clip comprises a body 136, a bar support 138 projecting in one direction from the body, and latches 140, 142 projecting in the opposite direction from the body. The preferred clip 134 latches into small rectangular notches 144 (FIG. 6) formed in the associated frame wall stiffening flanges 46 with the clip body extending adjacent the flanges 46. The notches 144 are relatively shallow and do not extend the full depth of the stiffening flanges 46. Accordingly the frame members are not materially weakened at the notch locations since the flanges 46 remain substantially intact and effective to strengthen the frame member.

The body 136 is a flat rectangular or square plate-like member having opposite margins 136*a*, 136*b* seated on the frame wall stiffening flanges 46. The latches 140, 142 project from the body between the flanges 46 into the channel formed by the frame member while the bar support 138 projects into the space 20.

The bar support 138 comprises a base flange 150 integral with the body 136, a central spine 152 projecting from the base flange, and bar retaining fingers 154 which fit into the muntin bar interior. When the bar support 138 is inserted into a bar 132 the open end of the muntin bar 132 extends about the base flange 150 and the fingers frictionally engage the muntin bar interior to secure it to the clip 134.

Each latch 140, 142 comprises a relatively rigid latch body member 156 projecting from the clip body and a thin latching finger 158 extending from the projecting end of the latch body back toward the adjacent clip body margin. Each latching finger is resiliently deflectable toward and away from the latch body. The latching body and finger are formed with a wedge face 160 on one side which facilitates inserting the clip into the receiving flange notch 144. The finger 158 is resiliently deflected by the flange notch edge as the clip is inserted into the frame member. When the finger 158 clears the notch edge the finger snaps back to its undeflected position and traps the flange 46 between the finger 158 and the clip body 136.

While a preferred embodiment of the invention has been illustrated and described in detail, the present invention is not to be considered limited to the precise construction disclosed. For example, an insulating glass unit constructed according to the present invention might employ a sealant body formed from multiple hot melt seals, multiple polyisobutylene seals, or from a single polyurethane or polysulfide seal. Such sealant bodies might be supplemented with still a further layer of sealant material extending about their peripheries. Various adaptations, modifications and uses of the invention may occur to those skilled in the art to which the invention relates and the intention is to cover hereby all such adaptations, modifications and uses which fall within the spirit or scope of the appended claims.

Having described my invention I claim:

1. A spacer assembly for an insulating glass unit comprising:

a. a spacer frame having first and second opposite ends and comprising a plurality of spacer frame elements connected to form a polygonal spacer frame disposed generally in a plane with frame corners formed by spacer frame element junctures;

b. each frame element defining a laterally extending outer peripheral wall and first and second lateral walls integral with said outer wall and extending inwardly therefrom generally parallel to said frame plane;

c. said outer wall and said lateral walls extending substantially continuously about the spacer frame between said opposite ends; and d. connecting structure for joining said first and second spacer frame ends; said connecting structure comprising:

i. a connecting tongue continuous with and projecting from said first spacer frame end, said tongue defined by a tongue body continuous with said outer wall and first and second tongue stiffening walls continuous with said first and second lateral walls, respectively, said tongue body having a lateral extent less than the lateral extent of said outer wall and the distance said tongue stiffening walls extend from said tongue body being less than the distance said lateral walls extend from said outer wall;

ii. said second spacer frame end defining at least a tongue receiving structure forming a telescopic joint with said tongue, said tongue receiving structure comprising keeper structure for engaging said tongue stiffening wall edges when said tongue and second spacer frame end are telescoped together;

iii. said tongue and tongue receiving structure sized relative to each other to define said telescopic joint between the spacer frame ends with said tongue body and stiffening walls extending within said receiving structure.

2. The spacer assembly claimed in claim 1 wherein said tongue is continuous with said first frame end at a frame corner, said tongue extending transversely with respect to the direction of extent of an associated frame element.

3. The spacer assembly claimed in claim 2 wherein said tongue defines a U-like cross sectional shape with said tongue stiffening walls engaging the lateral walls of said second spacer frame end.

4. The spacer assembly claimed in claim 3 further comprising a weak zone between each said tongue stiffening wall and its respective associated frame element lateral wall for enabling bending said tongue at the weak zone to form pleat-like wall regions.

5. The spacer assembly claimed in claim 1 wherein said keeper structure comprises flanges formed on said lateral walls at said second spacer frame end, each flange projecting from its respective lateral wall toward the other flange for engaging a respective tongue stiffening wall.

6. The spacer assembly claimed in claim 1 further including a shoulder formed at the juncture of said tongue and said first spacer frame end, said shoulder engaging said second frame end.

7. The spacer assembly claimed in claim 1 wherein said connecting structure further comprises a fastener for securing said spacer frame ends together.

8. The spacer assembly claimed in claim 7 wherein said connecting structure further comprises aligned openings in said tongue and tongue receiving structure, said fastener extending through said openings.

9. A spacer assembly for an insulating glass unit comprising:

a. a plurality of spacer frame elements connected to form a generally planar polygonal frame with frame element junctures forming frame corners;

b. each frame element defining an outer peripheral wall and first and second lateral walls integral with said outer wall and extending inwardly from opposite outer wall sides parallel to said frame plane;

c. each lateral wall defining a transverse stiffening flange having a projecting edge extending at least partially along the length thereof, said stiffening flanges extending generally toward each other with projecting edges spaced apart and spaced from said peripheral wall; and d. a muntin bar assembly supported by said frame, said muntin bar assembly comprising at least one bar member and clip means for securing said bar member to one frame element;

e. said clip means comprising a clip body engaging said one frame element and spanning said stiffening flanges, a muntin bar support member projecting from said body for supporting the muntin bar member relative to the clip body, and latch means for connecting said clip means to a frame element stiffening flange, said latch means comprising a relatively rigid latch body member projecting from said clip body beyond said stiffening flanges between said first and second lateral walls of said one frame element, and a resiliently deflectable finger for coupling said latch body member to one of said stiffening flanges and securing said latch body member against being removed from between said first and second lateral walls of said one spacer frame element, said one stiffening flange defining an abutment engagable with said latch body member to prevent movement of said clip means along said frame element, said clip body and the other stiffening flange secured together at a location spaced laterally from said stiffening flange abutment.

10. The spacer assembly claimed in claim 9 wherein said stiffening flange abutment is defined by a notch for receiving said latch body member and anchoring said clip means.

11. The spacer frame claimed in claim 9 wherein said frame defines opposite ends connected together by a telescopic joint, one of said ends comprising a projecting tongue and the other end defining a tongue keeper structure for securing said tongue in place when said ends are telescoped.

12. The spacer frame claimed in claim 11 wherein said tongue defines a U-like cross sectional shape comprising tongue walls continuous with said frame element lateral walls and a tongue body continuous with said frame element peripheral wall.

13. The spacer frame claimed in claim 12 wherein said tongue extends within said opposite frame end.

14. The assembly claimed in claim 9 wherein said clip means is secured to said other stiffening flange member by a second relatively rigid latch body member projecting from said clip body beyond said stiffening flanges between said first and second lateral walls and a second resiliently deflectable finger for coupling said second latch body member to said other stiffening flange and securing said second latch body member against being removed from between said first and second lateral walls, said other stiffening flange defining an abutment engagable with said second latch body member to prevent movement of said clip means along said frame element.

15. The assembly claimed in claim 14 wherein said second latch body member is fixed to said clip body at a location spaced from said first latch body member in the direction of extent of said frame element.

16. The assembly claimed in claim 14 wherein said first and second resiliently deflectable fingers are attached to said first and second latch body members, respectively, and each finger engages a respective stiffening flange to secure said latch body member in place.

17. The assembly claimed in claim 9 wherein said latch body member is in latching engagement with each of said stiffening flanges at two separate locations spaced apart along said frame element, each of said stiffening flanges defining abutment structures for engaging said clip means and preventing movement of said clip means along the frame element.

18. An article of manufacture constructed for forming part of an insulating glass unit spacer assembly which is subsequently hermetically sandwiched between glass lights, the article comprising:

a. a linearly extending spacer frame formed from a thin walled ribbon of sheet material having first and second opposite ends, the spacer frame comprising a plurality of substantially aligned frame elements, corner forming structures connecting adjacent frame element ends, and connecting structure formed at said first and second opposite ends; and, b. a sealant body attached to said spacer frame along each oppositely facing lateral side thereof;

c. said frame elements having a generally U-like cross sectional shape and comprised of an outer wall and first and second generally planar lateral walls continuous with said outer wall and extending therefrom at laterally spaced locations generally parallel to each other, each of said lateral walls terminating in a stiffening flange continuous therewith and remote from said outer wall, the stiffening flanges of the respective lateral walls extending towards each other transverse to the planes of the respective lateral walls, said stiffening flanges each terminating in an edge remote from the respective lateral wall with said stiffening flange edges spaced substantially apart from each other;

d. said corner forming structures formed continuously with said frame element lateral walls and each comprising a first weakened zone of said first lateral wall and a second weakened zone of said second lateral wall, each weakened zone comprising notch defining structure on each lateral wall interrupting each stiffening flange to facilitate bending the spacer frame at the corner forming structure, said weakened sections disposed at spacer frame locations aligned transversely with respect to the extent of said spacer frame, each said weakened zone bowed from the plane of its associated lateral wall toward the other aligned zone of weakness;

e. said sealant body engaging said bowed weakened zones f. said connecting structure comprises a tongue structure projecting from said first end, said tongue structure comprising an outer wall continuous with said frame element outer wall and lateral walls continuous with respective frame element lateral walls, said tongue structure defining a U-like cross sectional shape which is smaller the U-like cross sectional frame element shape so that said tongue structure can be telescoped within the frame element at said second end.

19. The article claimed in claim 18 wherein said corner forming structure further comprises score lines radiating along said weakened zones, said score lines weakening said lateral walls at said zones.

20. The article claimed in claim 18 wherein said connecting structure comprises a tongue element projecting from said first end, said corner structure further comprising tongue corner forming structure for connecting said tongue structure to said first end and enabling said tongue element to be flexed to extend transversely with respect to the adjoining frame element, said tongue corner forming structure comprising a first weakened zone of said first lateral wall and a second weakened zone of said second lateral wall, said first and second weakened zones disposed at spacer frame locations aligned transversely with respect to the extent of said spacer frame, each said weakened zone bowed from the plane of its associated lateral wall toward the other aligned weakened zone.

21. The article claimed in claim 20 wherein said connecting structure further comprises tongue element receiving structure formed by said second spacer frame end, said tongue element receiving structure and said tongue element frictionally secured against relative movement.

* * * * *